United States Patent [19]

Budzich

[11] 4,437,307

[45] Mar. 20, 1984

[54] PRIORITY FLOW CONTROL SYSTEM

[75] Inventor: Tadeusz Budzich, Moreland Hills, Ohio

[73] Assignee: Caterpillar Tractor Company, Peoria, Ill.

[21] Appl. No.: 357,035

[22] Filed: Mar. 11, 1982

[51] Int. Cl.[3] ..... F15B 13/08

[52] U.S. Cl. ..... 60/427; 60/452; 91/446; 91/516; 91/518; 137/596; 137/596.1; 137/596.13

[58] Field of Search ..... 60/427, 452; 91/446, 91/516, 517, 518; 137/596, 596.1, 596.13

[56] References Cited

U.S. PATENT DOCUMENTS 3,768,372 10/1973 McMillen ..... 91/516

4,282,898 8/1981 Harmon ..... 137/596.13

*Primary Examiner*—Gerald A. Michalsky

*Attorney, Agent, or Firm*—Sixbey, Friedman & Leedom

[57] ABSTRACT

A priority flow control system in which the priority feature is obtained by progressively lowering the pressure differential of nonpriority valves, once the maximum pump output is reached, so that all of the system valves always retain their compensated proportional flow feature.

18 Claims, 4 Drawing Figures

PRIORITY FLOW CONTROL SYSTEM

BACKGROUND OF THE INVENTION

This invention relates generally to fluid control valves provided with positive and negative load compensation.

In more particular aspects this invention relates to pressure compensated direction and flow control valves, the positive and negative load compensators of which are controlled by a single amplifying pilot valve stage.

In still more particular aspects this invention relates to pilot operated pressure compensated controls of direction control valves, used in control of positive and negative load, which permit variation in the level of control differential across metering orifices of the valve spool, while this control differential is automatically maintained constant at each controlled level.

In still more particular aspects this invention relates to pilot operated pressure compensated controls of direction control valves, which provide a priority feature for specific valves by controlling the pressure differential of all of the nonpriority valves.

Closed center fluid control valves, pressure compensated for control of positive and negative loads, are desirable for a number of reasons. They permit load control with reduced power losses and therefore, increased system efficiency. They also permit simultaneous proportional control of multiple positive and negative loads. Such fluid control valves are shown in my U.S. Pat. Nos. 4,180,098, issued Dec. 5, 1979 and also in my 4,222,409 issued Sept. 16, 1980. However, the valves of those patents although capable of proportional control of positive and negative loads, use for such control the energy directly transmitted through the load pressure sensing ports, which not only attenuate the control signals, but limit the response of the control. Those valves also automatically maintain a constant pressure differential across metering orifices in control of both positive and negative loads. In those valves the priority feature is obtained by throttling the fluid flow to the down stream valves, so that the priority valve is always assured to the required flow, once the maximum flow output of the system pump is reached. Also in those valves the construction of the priority valve is substantially different from the nonpriority valves and the priority valve must work in a series type circuit.

SUMMARY OF THE INVENTION

It is therefore a principal object of this invention to provide a priority flow control system, in which the proportionality of flow of nonpriority valves is not lost, while the fluid flow is being diverted to the priority valve, once the system pump reaches its maximum flow output.

Another object of this invention is to provide a priority flow control system, in which the pressure differential of the nonpriority valves is progressively lowered once the system pump reaches its maximum flow output, automatically providing the priority valve with the required flow.

It is a further object of this invention to provide a priority flow control system based entirely on the principle of the parallel flow circuit.

It is a further object of this invention to provide a priority feature to a specific valve with a minimum amount of fluid throttling, thus increasing system efficiency.

It is a further object of this invention to provide a priority flow control system, in which the priority and nonpriority compensated control valves work in parallel circuit.

It is a further object of this invention to provide a priority flow control system, in which the priority and nonpriority compensated flow control valves are essentially of the same construction.

It is a further object of this invention to provide a priority flow control system, in which the nonpriority valves can be controlled by a number of different control inputs, in providing the priority feature.

It is a further object of this invention to provide a system, in which the pressure differential and therefore maximum flow limit of all of the system valves is automatically progressively lowered, once the maximum capacity of the system pump is reached, so that none of the system valves ever lose the compensated proportional flow feature.

Briefly the foregoing and other additional objects and advantages of this invention are accomplished by providing a novel priority flow control system, in which maximum flow capacity of the nonpriority valves is automatically progressively lowered, once the system pump reaches its maximum flow output, so that the priority flow is provided without losing the proportional compensated flow feature of all of the system valves, in parallel type circuit and at maximum efficiency level. In this way a priority feature can be provided for any specific valve, controlling a specific function, while all of the system valves remain essentially the same. The priority feature can be provided, while using many different control signals, resulting in an extremely flexible control system.

Additional objects of this invention will become apparent when referring to the preferred embodiments of the invention as shown in the accompanying drawings and described in the following detailed description.

DESCRIPTION OF THE PREFERRED EMBODIMENTS

Figure 1:
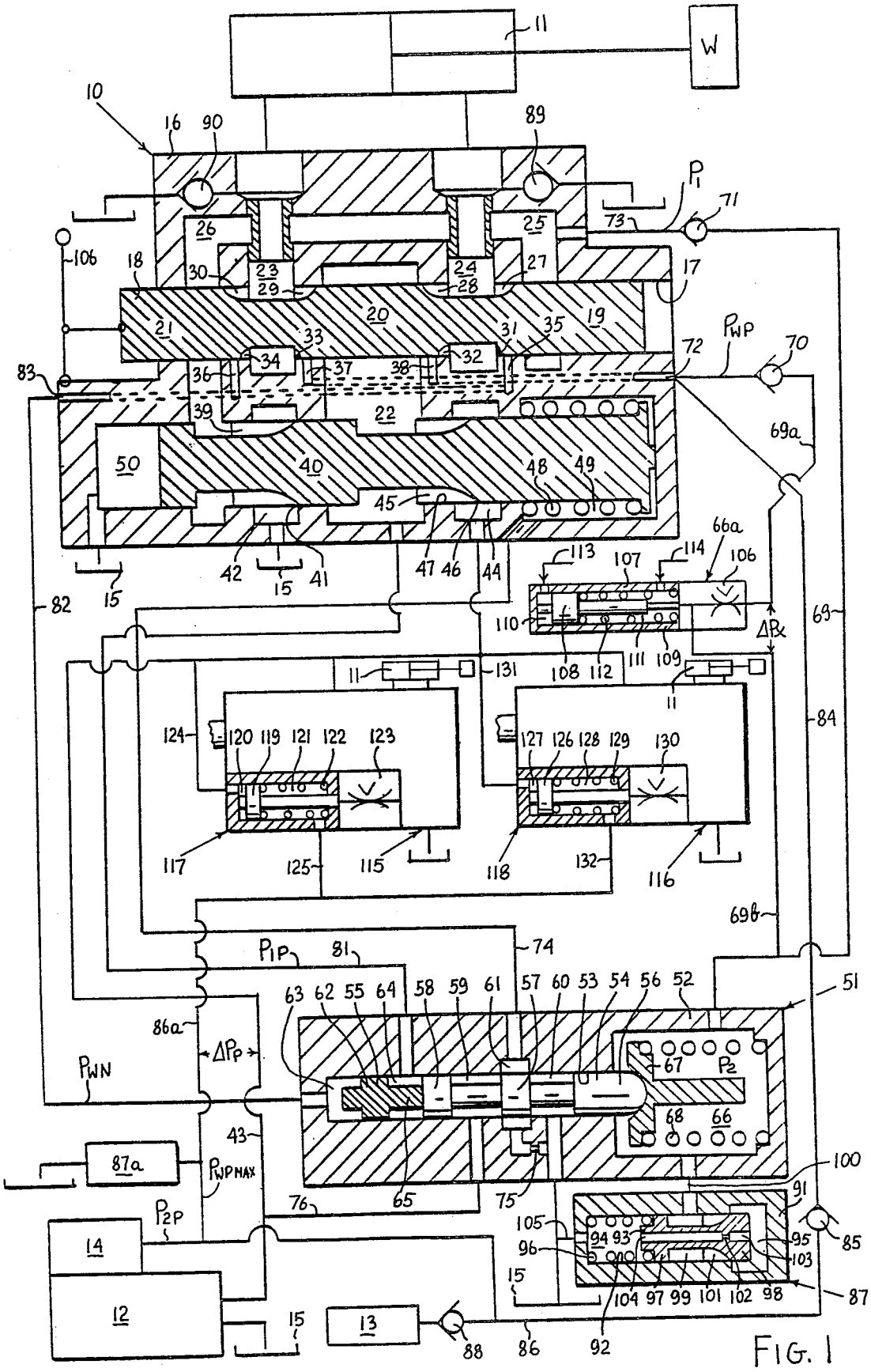
FIG. 1 is a sectional view of an embodiment of a priority flow control valve, with schematically shown nonpriority system valves, responsive to the pressure differential of the system pump.

Referring now to FIG. 1, an embodiment of a priority flow control valve, generally designated as 10, is shown interposed between diagrammatically shown fluid motor 11 driving load W and a pump 12 of a fixed displacement or variable displacement type, driven by a prime mover, not shown. Fluid flow from the pump 12 to priority flow control valve 10 and a circuit of diagrammatically shown flow control valve 13 is regulated by pump flow control 14. If pump 12 is a fixed displacement type, pump flow control 14 is a differential pressure relief valve, which, in a well known manner, by bypassing fluid from pump 12 to a reservoir 15, maintains discharge pessure of pump 12 at a level, higher by a constant pressure differential, than load pressure developed in fluid motor 11. If pump 12 is of a variable displacement type, pump flow control 14 is a differential pressure compensator, well known in the art, which by changing displacement of pump 12, maintains discharge pressure of pump 12 at a level, higher by a constant pressure differential, than load pressure developed in fluid motor 11.

The pump flow control 14 may also be a maximum pressure compensator or relief valve, which maintains the discharge pressure of the pump 12 at a maximum constant pressure level during operation of the system.

The priority flow control valve 10 is of a four way type and has a housing 16 provided with a bore 17, axially guiding a valve spool 18. The valve spool 18 is equipped with lands 19, 20 and 21, which in neutral position of the valve spool 18, as shown in the drawing, isolate a fluid supply chamber 22, load chambers 23 and 24 and outlet chambers 25 and 26. lands 19, 20 and 21, of valve spool 18, are provided with metering slots 27, 28, 29 and 30 and signal slots 31, 32, 33 and 34. Negative load sensing ports 35 and 36 are positioned between load chambers 23 and 24 and outlet chambers 26 and 25. Positive load sensing ports 37 and 38 are located between supply chamber 22 and load chambers 23 and 24.

Negative load throttling slots 39, of control spool 40, equipped with throttling edges 41, connect outlet chambers 26 and 25 with an exhaust chamber 42, which in turn is connected to reservoir 15.

The pump 12, through its discharge line 43, is connected to an inlet chamber 44. The inlet chamber 44 is connected through positive load throttling slots 45, on control spool 40, provided with throttling edges 46, with the fluid supply chamber 22. Bore 47 axially guides the control spool 40, which is biased by control spring 48, contained in control space 49, towards position as shown. The control spool 40 at one end projects into control space 49, the other end projecting into chamber 50, connected to the reservoir 15. A pilot valve assembly, generally designated as 51, comprises a housing 52, provided with a bore 53, slidably guiding a pilot valve spool 54 and a free floating piston 55. The pilot valve spool 54 is provided with lands 56, 57 and 58, defining annular spaces 59 and 60. Annular space 61 is provided within the housing 52 and communicates directly with bore 53. The free floating piston 55 is provided with a land 62, which defines annular spaces 63 and 64 and is provided with extension 65 selectively engageable with land 58 of the pilot valve spool 54. The pilot valve spool 54 at one end projects into control space 66 and engages, with its land 56 and spring retainer 67, a pilot valve spring 68. Control space 66 communicates through lines 69 and **69*b* and a controller, generally designated as 66*a*, and through line 69*a* with check valve 70 and through line 69 with check valve 71. The check valve 70 is connected by passage 72 with positive load sensing ports 37 and 38. The check valve 71 communicates through line 73 with the outlet chamber 25. Annular space 61, of the pilot valve assembly 51, communicates through line 74 with control space 49 and also communicates, through leakage orifice 75, with annular space 60, which in turn is connected to reservoir 15. Annular space 59 communicates through line 76 with discharge line 43. Annular space 64 is connected by line 81 with the supply chamber 22. Annular space 63 is connected by line 82 and passage 83 with negative load sensing ports 36 and 35. Positive load sensing ports 37 and 38 are connected through passage 72, line 84 and a check valve 85 and a signal line 86 with the pump flow control 14. Control space 66 is connected through a flow control, generally designated as 87, with the reservoir 15. Flow control 87 is a flow control device, passing a constant flow from control space 66 to the reservoir 15. The load chambers 23 and 24 are connected, for one way fluid flow, by check valves 89 and 90, to schematically shown system reservoir, which also might be a pressurized exhaust manifold of the entire control system, as shown in the drawing. The flow control, generally designated as 87, is interposed between control space 66 and the system reservoir 15 and comprises a housing 91, provided with a bore 92, guiding a flow control spool 93, which defines spaces 94 and 95 and which is biased by a spring 96. The flow control spool 93 is provided with lands 97 and 98, defining annular space 99, which is connected by line 100 with control space 66. The flow control spool 92 is also provided with throttling slots 101 and leakage orifice 102, which communicates through passages 103 and 104, space 95 with space 94, space 94 being connected by line 105 with system reservoir 15**.

The controller, generally designated as **66*a*, is interposed between control space 66 and check valve 70, communicating with positive load sensing ports 37 and 38 and comprises schematically shown variable orifice section 106, operated by an actuating section 107. The actuating section 107 is provided with a piston 108, guided in a housing 109, defining spaces 110 and 111 and biased towards position as shown by a spring 112. Space 110 is subjected to an external fluid power control signal 113, while space 111 is subjected to a control signal 114**.

Schematically shown nonpriority control valves, generally designated as 115 and 116, are identical to the priority flow control valve 10 and are each provided with an identical pilot valve section 51, flow control section 87 and controllers 117 and 118, similar to the controller **66*a***.

The controller 117 is provided with a piston 119, defining spaces 120 and 121, is biased by a spring 122 and is operably connected to a variable orifice section 123. Space 120 is connected by line 124 to discharge line 43 while space 121 is connected by a line 125 and lines **86*a* and 86** to the check valve logic circuit, sensing maximum positive load pressure of the priority control system.

The controller 118 is provided with a piston 126, defining spaces 127 and 128, is biased by a spring 129 and is operably connected to a variable orifice section 130. Space 127 is connected by line 131 to discharge line 43, while space 128 is connected by a line 132 and lines **86*a* and 86** to the check valve logic circuit, sensing maximum positive load pressure of the priority control system.

Figure 2:
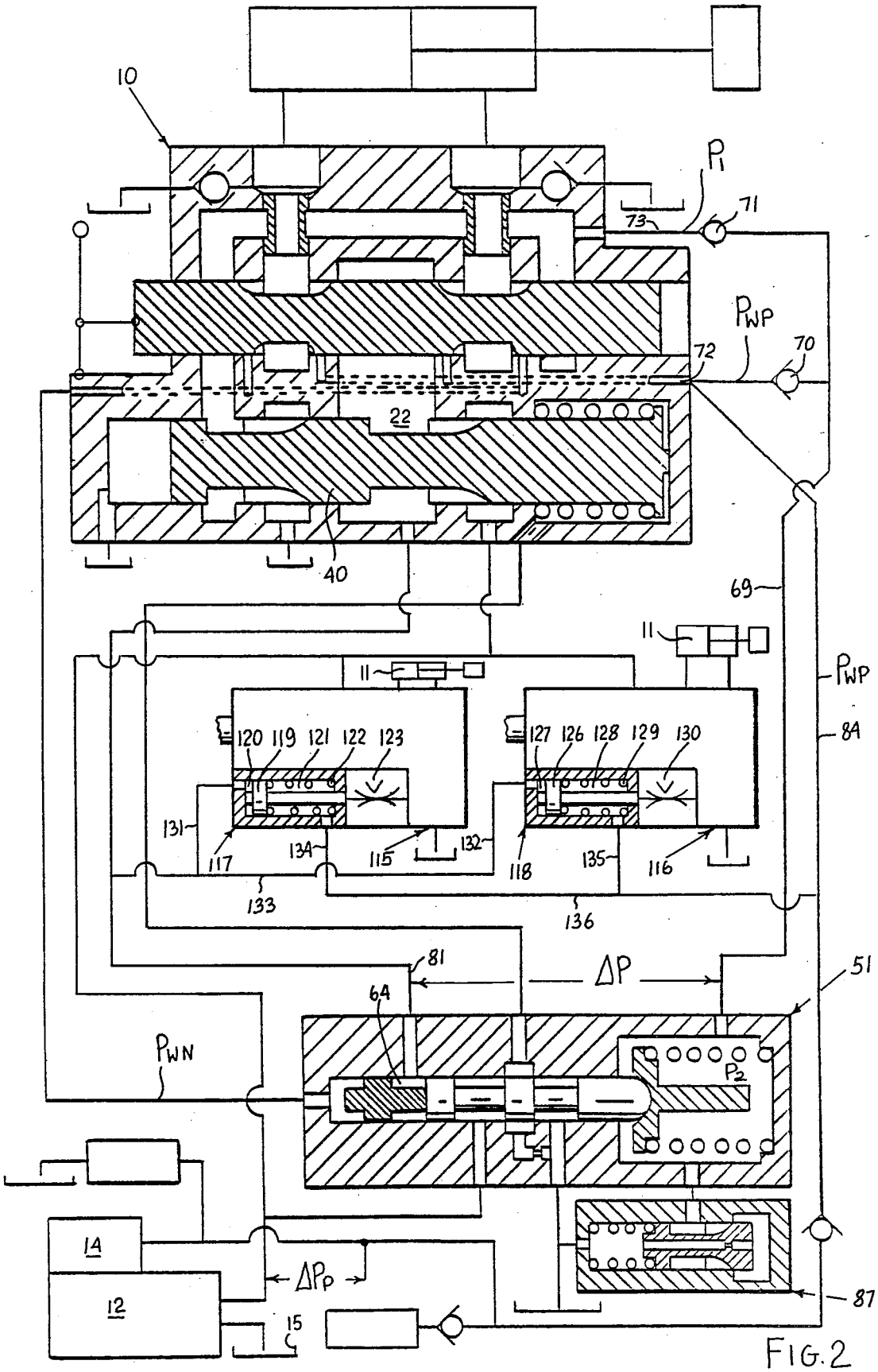
FIG. 2 is a sectional view of an embodiment of a priority flow control valve, with schematically shown nonpriority system valves, responsive to the pressure differential of the priority valve.

Referring now to FIG. 2, like components of FIGS. 1 and 2 are designated by the same numerals. The priority flow control valves 10, the pilot valve sections 51, the flow control sections 87 and the nonpriority valves 115 and 116, with their controllers 117 and 118, are identical in both priority systems. However, spaces 120 and 127 are connected by lines 131, 132 and 133 to line 81, which communicates with the supply chamber 22, while spaces 121 and 128 are connected by lines 134 and 135 and line 136 to the positive load sensing system of the priority control valve 10.

Figure 3:
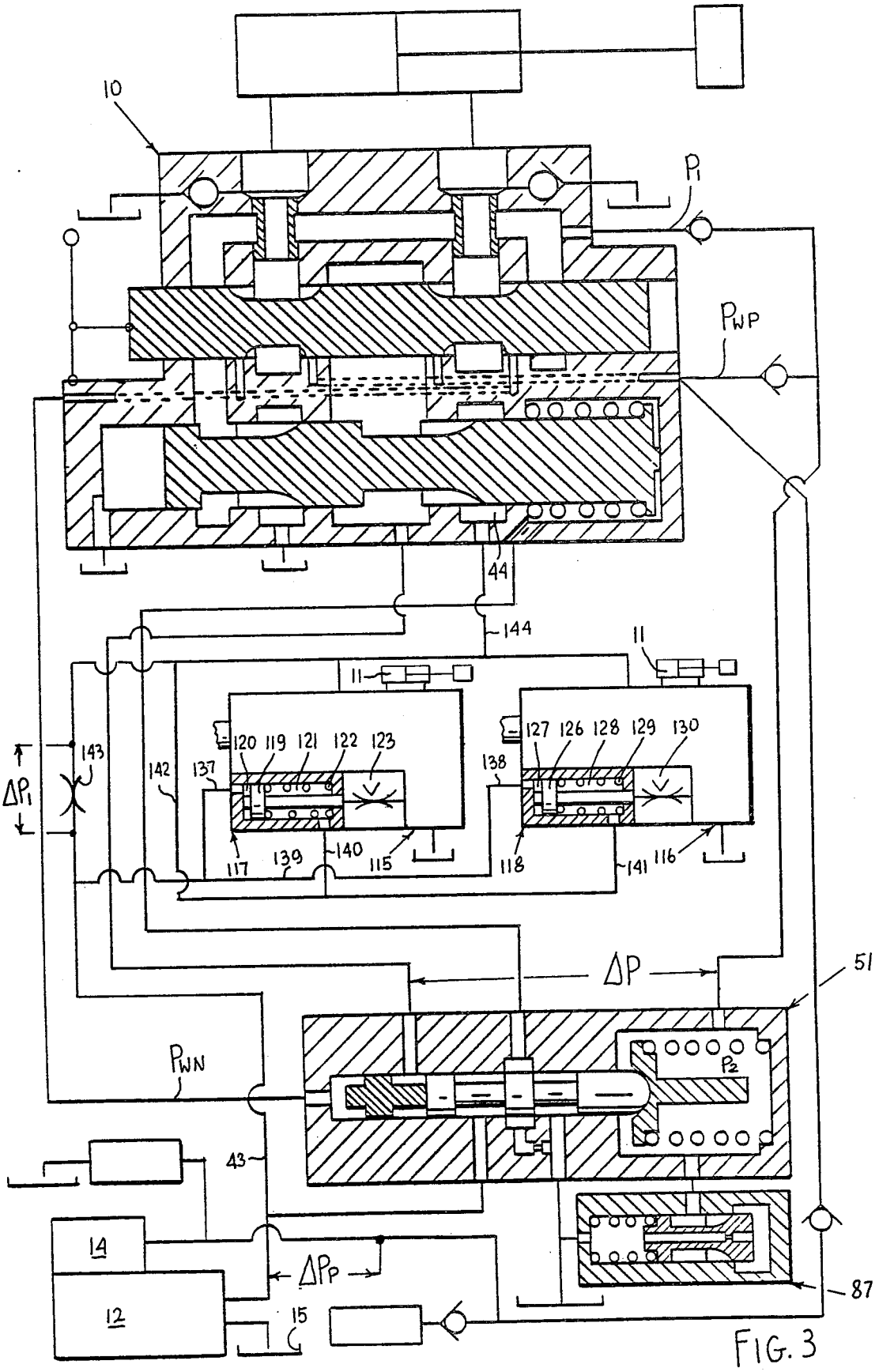
FIG. 3 is a sectional view of an embodiment of a priority flow control valve, with schematically shown nonpriority system valves, responsive to pressure differential across an orifice, subjected to full flow of the system pump.

Referring now to FIG. 3, like components of FIGS. 1, 2 and 3 are designated by the same numerals. The priority flow control valves 10, the pilot valve sections 51, the flow control sections 87 and the nonpriority valves 115 and 116, with their controllers 117 and 118, are identical in all of those priority systems. However, spaces 120 and 127 are connected by lines 137, 138 and 139 to discharge line 43, while spaces 121 and 128 are connected to lines 140, 141 and 142 to downstream of metering orifice 143. Line 142 is connected by line 144 to the inlet chamber 44 of the priority control valve 10.

Figure 4:
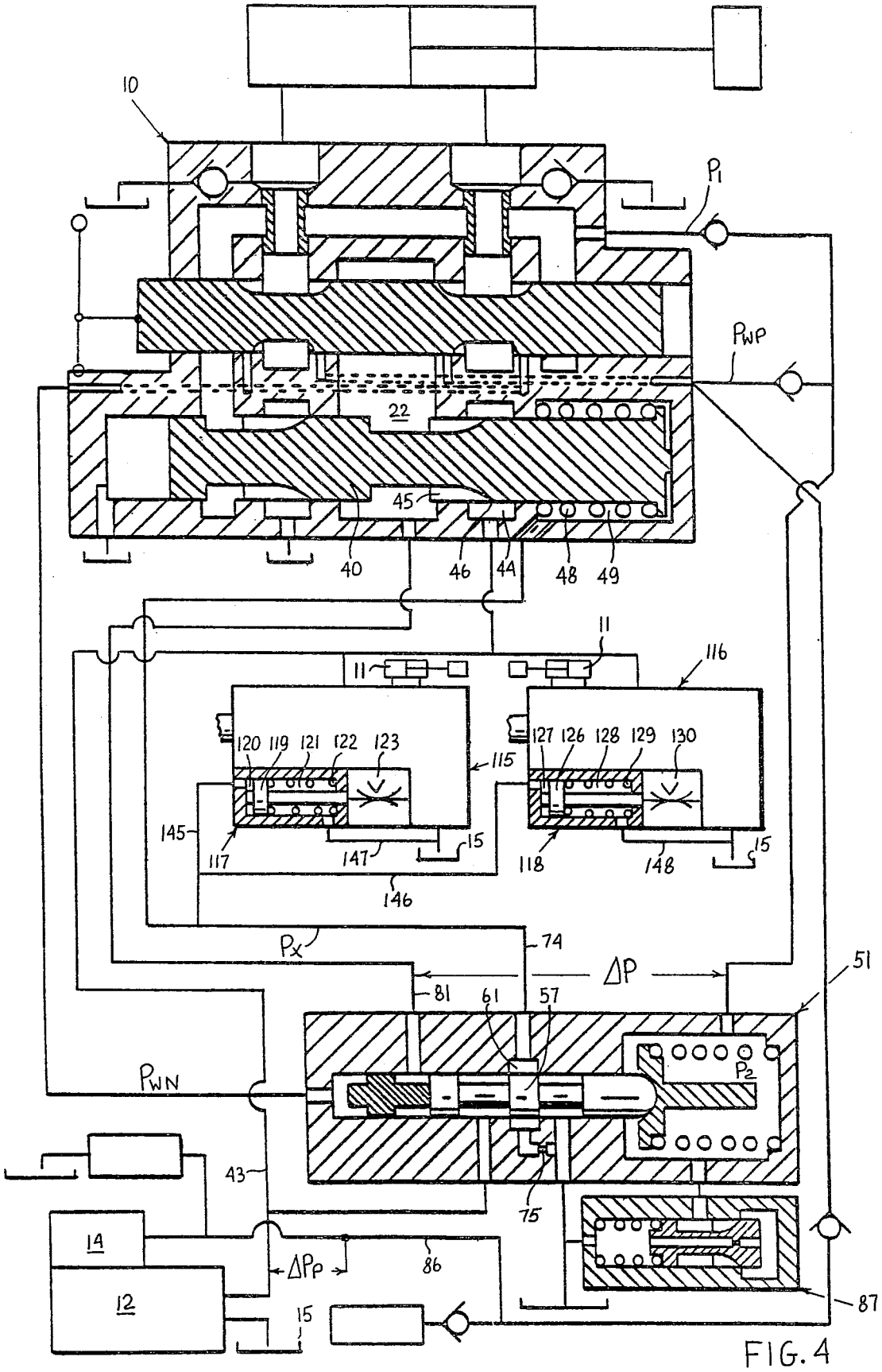
FIG. 4 is a sectional view of an embodiment of a priority flow control valve, with schematically shown nonpriority system valves, responsive to control pressure of the throttling controller of the priority valve.

Referring now to FIG. 4, like components of FIGS. 1, 2, 3 and 4 are designated by the same numerals. The priority flow control valve 10, the pilot valve section 51, the flow control section 87 and the nonpriority valves 115 and 116, with their controllers 117 and 118, are identical in all of these priority systems. However, spaces 120 and 127 are connected by lines 145 and 146 with line 74, which connects annular space 61 of the pilot valve assembly 51 with control space 49 of the priority control valve 10, while spaces 121 and 128 are connected by lines 147 and 148 with the system reservoir 15.

Referring back now to FIG. 1, the preferable sequencing of lands and slots of valve spool 18 is such, that when displaced in either direction from its neutral position, as shown in the drawing, one of the load chambers 23 or 24 is connected by signal slot 32 or 33 to the positive load sensing port 37 or 38, while the other load chamber is simultaneously connected by signal slot 31 or 34 with negative load sensing port 35 or 36, the load chamber 23 or 24 still being isolated from the supply chamber 22 and outlet chambers 25 and 26. Further displacement of valve spool 18 from its neutral position connects load chamber 23 or 24 through metering slot 28 or 29 with the supply chamber 22, while simultaneously connecting the other load chamber through metering slot 27 or 30 with outlet chamber 25 or 26.

As previously described the pump flow control 14, in a well known manner, will regulate fluid flow, delivered from pump 12, to discharge line 43, to maintain the pressure in discharge line 43 higher, by a constant pressure differential, than the highest load pressure signal transmitted through the check valve system to signal line 86. Therefore, with the valve spool 18, of priority flow control valve 10, in its neutral position blocking positive load sensing ports 37 and 38, signal pressure input to pump flow control 14 from signal line 86 will be at minimum pressure level, corresponding with the minimum standby pressure of the pump 12. The control pressure differential ΔPp of the pump flow control will be maintained at its constant predetermined level as long as the maximum flow output of the pump is not reached. Once this condition is reached the control pressure differential will reduce.

As shown in FIG. 1, the priority flow control valve 10 is interposed between a schematically shown pump 12 and the fluid motor 11. The pilot valve assembly 51, in a manner as will be described later in the text, regulates the position of the control spool 40 to control the pressure differential ΔPyp developed across orifices created by displacement of metering slots 28 and 29 and to control the pressure differential ΔPyn, across orifices created by displacement of metering slots 27 and 30. Control space 66 of the pilot valve assembly 51 is connected to the system reservoir 15 by the flow control, generally designated as 87, which is a constant flow device, passing a constant flow of fluid from control space 66 to the reservoir 15, irrespective of the magnitude of control pressure P2, in a manner as will be described later in the text. This constant flow of fluid passes through the controller 66*a*, which is interposed between the positive load pressure sensing circuit of priority flow control valve 10 and control space 66 of the pilot valve assembly 51. In a well known manner, for each specific position of the piston 108 and equivalent area of variable orifice of variable orifice section 106 a constant pressure differential, equal to ΔPx will be developed across the controller 66*a*. It is assumed, when describing the operation of the flow control valve of this invention, that with the piston 108 displaced by the spring 112 all the way to the left, the pressure differential ΔPx becomes so small that the value of control pressure P2 approaches the value of Pwp pressure.

Assume that the valve spool 18 is displaced by the manual lever 106 from left to right by sufficient amount to connect with signal slot 33 the load chamber 23 with positive load sensing port 37, while the load chamber 23 is still isolated from the supply chamber 22. Assume also that the load chamber 23 is subjected to a positive load pressure Pwp. The load pressure Pwp transmitted to passage 72 will open the check valve 70, close the check valve 71 and will be transmitted through line 69*a* to the controller 66*a*. Assume that due to full displacement to the left of the piston 108 the pressure drop ΔPx becomes negligible. The load pressure Pwp will be then directly transmitted to control space 66 with P2 becoming Pwp pressure. Control space 66 is connected through the flow control section 87 with the system reservoir 15. In a well known manner, the flow control spool 93 will automatically assume a throttling position, throttling the fluid from control space 66 at Pwp pressure, by action of throttling slots 101, to a pressure, equivalent to the preload of spring 96. Therefore space 95 will be always maintained at a constant pressure as dictated by the preload in the spring 96. Space 95 is connected through passage 103, leakage orifice 102 and passage 104 with space 94, connected to system reservoir 15 by line 105. Therefore, with constant pressure differential automatically maintained across leakage orifice 102, a constant flow, at a certain preselected minimum level, will take place from space 95 and control space 66, irrespective of the level of Pwp or P2 pressure. With the controller 66*a* in a fully open position, equivalent to minimum resistance to flow, P2 pressure will always equal Pwp pressure. The pilot valve spool 54 is subjected to Pwp pressure in the control space 66, preload of the pilot valve spring 68 and pressure P1p in annular space 64, which is connected by line 81 to the supply chamber 22, which in turn is connected, through throttling slots 45, with the inlet chamber 44, connected by discharge line 43 to the pump 12. Under the action of those forces the pilot spool 54 will move into a modulating position, as shown in FIG. 1, regulating the pressure in the control space 49 and therefore position of the control spool 40, throttling by throttling edges 46 the fluid flow from the inlet chamber 44 to the supply chamber 22, to maintain a constant pressure differential between annular space 64 and control space 66, equivalent to preload of the pilot valve spring 68. The free floating piston 55, subjected to pressure differential between annular spaces 64 and 63, will move all the way to the left, out of contact with the pilot spool 54, Since the supply chamber 22 is closed by position of the valve spool 18 from the load chamber 23 the control spool 40 will assume a position, in which throttling edges 46 will completely isolate the inlet chamber 44 from the supply chamber 22.

Assume that the valve spool 18 is further displaced by the manual lever 106 from left to right, creating a metering orifice of specific area between the supply chamber 22 and the load chamber 23 through metering slot 29. Assume also that the load chamber 23 is subjected to a positive load pressure Pwp. Fluid flow will take place from the supply chamber 22, through created metering orifice, to the fluid motor 11, the pilot valve assembly automatically throttling, through the position of the control spool 40, the fluid flow from the inlet chamber 44 to the supply chamber 22, to maintain across created metering orifice a constant pressure differential of $\Delta Pyp$ equal to $\Delta P$, which in turn is equal to the quotient of the preload of the pilot valve spring 68 and the cross-sectional area of the pilot valve spool 54. Since a constant pressure differential is maintained across created metering orifice a constant flow of fluid will be supplied to fluid motor 11, irrespective of the variation in the magnitude of the load W. Therefore under those conditions the flow to the fluid motor 11 becomes directly proportional to the flow area of the created metering orifice and independent of Pwp pressure.

Assume that while controlling a positive load W, in a manner as described above, the piston 108 of the controller **66*a* was moved back into an intermediate position, creating a resistance to constant flow, by reduction in flow area of metering orifice. Assume also that due to that resistance a pressure differential $\Delta Px$ is developed across the variable metering orifice section 106 of the controller 66*a*. Then the control space 66 will be subjected to P2 pressure which is equal to the difference between Pwp pressure and $\Delta Px$. It can be seen that $\Delta Pyp = P1p - Pwp$, which is the pressure differential through created metering orifice, $P1p - P2 = \Delta P$, which is the constant pressure differential caused by the preload of the pilot valve spring 68 and that $Pwp - P2 = \Delta Px$. From the above three equations, when substituting and eliminating P1p, Pwp and P2 pressures, the basic relationship of $\Delta Pyp = \Delta P - \Delta Px$ is obtained. With $\Delta Px = 0$ which is the case, as explained above, when the controller 66*a* is in its fully open position, $\Delta Pyp = \Delta P$ and the flow through the created metering orifice to the fluid motor is controlled at maximum constant pressure differential. Any value of $\Delta Px$, as can be seen from the basic equation, will automatically lower, by the same amount, $\Delta Pyp$, acting across created metering orifice, automatically reducing the quantity of fluid flow to the fluid motor 11, this flow still being maintained constant at a constant level and independent of the variation in the magnitude of load W. Therefore, by controlling the value of $\Delta Px$, by the action of controller 66*a*, the pressure differential $\Delta Pyp$ is controlled, controlling the velocity of load W. In a similar way the velocity of the load W and therefore the flow into the fluid motor 11 can be controlled by the variation in the area of the orifice created by displacement of the valve spool 18**, at any controlled level of $\Delta Pyp$, as dictated by the value of $\Delta Px$.

Assume that the valve spool 18 is displaced by the manual lever 106 from left to right by a sufficient amount to connect with signal slot 31 the load chamber 24 with negative load sensing port 35, while the load chamber 24 is still isolated from the outlet chamber 25. Assume also that the load chamber 24 is subjected to a negative load pressure Pwn. Then the pressure signal at Pwn pressure will be transmitted through passage 83 and line 82 to annular space 63 and react on the cross-sectional area of the free floating piston 55. Assume also that when communication between the load chamber 24 and the outlet chamber 25 closed no pressure signal is transmitted through line 69 and that control space 66 is subjected to reservoir pressure, by the action of the flow control section 87. The pilot valve spool 54 will be displaced by the free floating piston 55 all the way to the right, connecting annular space 61 and the control space 49 with annular space 59, subjected to pump discharge pressure through line 76. The control spool 40 will automatically move all the way from right to left, with the throttling edges 41 cutting off communication between the exhaust chamber 42 and the outlet chamber 26 and therefore isolating outlet chambers 25 and 26 from the system reservoir 15.

Assume that the valve spool 18 is further displaced by the manual lever 106 from left to right, creating a metering orifice of specific area between the load chamber 24 and the outlet chamber 25, subjected to negative load pressure Pwn. With the control spool 40 blocking the outlet chamber 26 from the exhaust chamber 42, the negative load pressure will be automatically transmitted through line 73, will open the check valve 71, close the check valve 70 and will be transmitted through line 69 to the control space 66. The P1 pressure in control space 66 will react on the cross-sectional area of pilot valve spool 54, the pilot valve spring 68 bringing it into its modulating position, as shown in the drawing and controlling the pressure in the control space 49, to establish a throttling position of the control spool 40, which will maintain a constant pressure differential across created metering orifice, as dictated by the preload of the pilot valve spring 68. Then Pwn-Pz will equal constant $\Delta P$, which is equal to the quotient of the preload of the pilot valve spring 68 and the cross-sectional area of the pilot spool 54. Since a constant pressure differential of $\Delta Pyn = \Delta P$ is maintained across the created metering orifice, flow out of the fluid motor 11 will be proportional to the area of the created metering orifice and independent of the magnitude of the negative load W. Therefore in this way, by varying the flow area of the metering orifice created by displacement of the valve spool 18, the velocity of the negative load W can be controlled, each area of orifice representing a specific constant flow level, independent of the magnitude of the load W.

During control of positive load the free floating piston 55 is forceably maintained by a pressure differential out of contact with the pilot valve spool 54. During control of negative load the free floating piston 55 acts together with the pilot spool 54. During control of positive load the pressure differential across the orifice created by displacement of the valve spool 18, is controlled by the throttling action of positive load throttling slots 45. During control of negative load the pressure differential across the orifice created by displacement of the valve spool 18, is maintained by the throttling action of the negative load throttling slots 39. During control of positive load pressure differential, acting across created metering orifice can be varied by the controller **66*a***.

Assume that the flow control valves 10, 115 and 116 are controlling positive loads, that the ΔPx of the controller 66a is very small and that the flow control valve 10 is the priority flow control valve of the system, which is also using the nonpriority compensated valves 115 and 116. The nonpriority valves 115 and 116 are, in all aspects, identical to the priority valve assembly 10 and include the pilot valve sections 51 and the flow control sections 87. The controller sections 66a, 117 and 118 act in a similar way, modifying the positive load pressure signal on its way to the pilot valve assembly and therefore, in a manner as previously described, by controlling ΔPx control the basic control pressure differential ΔPy. There is however one difference between the controller 66a and the controllers 117 and 118. While at rest, biased by the spring 112, the piston 108 actuates the variable metering orifice section 106 towards its maximum orifice position. The controllers 117 and 118, biased by springs 122 and 129, actuate the variable metering orifice sections 123 and 130 towards the position, equivalent to the minimum area of the metering orifice and therefore equivalent to minimum pressure differential ΔPy. The displacement of the pistons 119 and 126 to the right will increase the areas of the signal throttling orifices, decreasing the pressure differential ΔPx and proportionally increasing the control pressure differential ΔPy, until a point is reached, at which, ΔPx becomes very small and ΔPy approaches the value of ΔP, which is the basic pressure differential of the control valves.

The pump 12, provided with a load responsive flow control 14, in a well known manner, will maintain a constant pressure differential ΔPp, which is determined by a constant difference between pump discharge pressure and maximum positive load system pressure. The pressure differential ΔPp is normally selected higher than ΔP, which is the constant pressure differential of the compensator of the flow control valve. This pressure differential ΔPp is applied across the pistons 119 and 126, of the controls 117 and 118. The spring characteristics o the springs 122 and 129 are so selected, that when subjected to the force developed, due to pressure differential ΔPp, acting on the cross-sectional area of the pistons 119 and 126, those pistons are moved all the way from left to right, providing maximum area of signal orifice and minimum value of ΔPx. As long as the maximum pump flow output is not exceeded, all of the system valves work with maximum constant control pressure differential. As soon as the flow demand of the system exceeds the capacity of the pump, ΔPp becomes smaller and the controllers 117 and 118 move proportionally into an intermediate position, progressively reducing the control pressure differential ΔPy, of the nonpriority flow control valves 115 and 116. The reduced pressure differential of the non-priority valves, proportionally reduces the flow, passing through those valves, while those valves still retain full proportionality of the control and while more flow becomes available for the priority valve.

The performance of the priority flow control system of FIG. 1 represents a new type of priority control with many unusual and beneficial characteristics. A conventional priority system can only operate in a series type system, with fluid flow being subjected to the throttling action, on its way to the down stream nonpriority valves. In the system of the present invention the priority feature is obtained in a parallel circuit.

In conventional priority circuits, once the capacity of the pump is exceeded and the priority section starts throttling, all of the other nonpriority valves may lose their proportionality feature. In the present invention, while priority flow is being directed to the priority valve, all of the other nonpriority valves fully retain their proportionality feature.

In conventional priority circuits large throttling loss takes place in the priority valve section. In the present invention by gradually reducing the pressure differential of the nonpriority valves, none of those large throttling losses take place, with the system working at high efficiency level.

In conventional priority circuits the priority valve is provided with a priority bypass throttling section and therefore is substantially different from the nonpriority valves. In the present invention the priority and nonpriority valves of the system are identical.

In conventional priority circuits the maximum flow of the priority valve is fixed at a certain predetermined level. In the control system of the present invention, by varying the control pressure differential, maximum flow through the priority valve can be adjusted to any desired level.

In conventional priority systems the priority valve, during control of negative load, may absorb full flow of the pump. In the system of the present invention, during control of negative load, the priority valve automatically loses its priority feature. Then, as soon as the maximum pump flow output is reached, all of the other nonpriority valves automatically progressively reduce their pressure differential and therefore their flow output, the loss of proportionality of any one of those valves being completely impossible.

Referring now to FIG. 2, the basic components of the priority system are identical to that of FIG. 1, with the exception of the absence of the positive load signal throttling controller 66a, in the internal control circuit of the priority valve. The controllers 117 and 118 are made responsive not to ΔPp of the pump, but to pressure differential ΔP of the priority valve. This pessure differential will automatically full actuate the controllers 117 and 118 and maintained them in position of minimum ΔPx and maximum ΔPy approaching the value of ΔP. Once the pump 12 will reach its maximum flow output, the pressure differential ΔP of the priority valve will decrease, automatically progressively decreasing the pressure differential of all of the nonpriority valves. The final effect is the same as that, described when referring to FIG. 1, the system of FIG. 2 providing all of the same advantages.

Referring now to FIG. 3, the components of the priority flow control system of FIG. 3 are identical to those of FIG. 2, with the controllers 117 and 118, of the nonpriority valves, being made responsive to the pressure differential ΔP1, across control orifice 143. There is one basic difference between the controllers 117 and 118 of FIG. 3, as compared to those of FIG. 2. With the pistons 119 and 126 in a fully extended position, the pressure differential ΔPx is at its minimum value, with the control pressure differential ΔPy approaching the value of ΔP. The pressure differential ΔP1 developed across the control orifice increases with flow and reaches its maximum value at maximum pump output. The preload in the springs 122 and 129 is so selected, that the pressure differential ΔP1, before the maximum flow output of the pump is reached, will automatically start reducing the pressure differential of the nonpriority valves 115 and 116, with the system working in an identical manner and providing identical advantages, as the systems described when referring to FIGS. 1 and 2.

Referring now to FIG. 4, the basic components of the priority system are the same as those of FIG. 2 and perform in an identical way, with the controllers 117 and 118 in FIG. 4 being directly responsive to the pressure Px in control space 49. The pressure in the control space 49, equivalent to preload of the control spring 48, is so selected, that it will move the pistons 119 and 126 all the way from left to right into the position, equivalent to minimum ΔPx and maximum ΔPy, which approaches the value of ΔP. This can be accomplished, since the spaces 121 and 128 are connected to system reservoir. As long as the control pressure Px in the control space 49 exceeds the preload of the control spring 48, the priority valve 10 is throttling the fluid flow to the positive load and therefore is receiving the required flow. Drop in the control pressure Px in control space 49, below this critical level, with the valve spool 40 in the position as shown in FIG. 4, signifying that the system pump has reached its maximum flow output, will progressively reduce the pressure differential of the nonpriority valves, automatically increasing the flow into the priority circuit. The basic operation of the system of FIG. 4 and its advantages are identical to those of the systems of FIGS. 1, 2 and 3.

A number of advantages of the priority system of this invention, over a conventional priority system, were previously described, when referring to FIG. 1. There is another basic advantage of the present invention.

In a conventional priority series type system the throttling control of the priority valve responds to its own pressure differential, trying to maintain it constant by varying the quantity of the bypass flow to the nonpriority valves, located down stream. In the priority system of the present invention the priority controls can respond to a number of different types of control signals, while providing identical performance. Examples of priority controls, using different control signals, are shown in FIGs. 1 to 4. The great flexibility of the priority system and the possibility of selection of different control signals, in operation of the priority controls, permits easy integration of the priority valves into the total hydraulic system. Four representative types of control signals, used in priority controls, are shown in FIGs. 1 to 4. As will be apparent to those skilled in the art, other types of control signals could be used. For example the gradual increase in ΔPx of the nonpriority valve and therefore gradual increase in ΔPy can be made responsive to the position of the displacement changing mechanism of the pump, or position of the bypass spool of the bypass valve, controlling the output of the pump, or pump RPM, if the pump is of a fixed displacement type etc.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A priority flow control system supplied from a source of pressure fluid and connected to exhaust means said priority flow control system including a priority valve assembly operable to control a load and at least one other valve assembly said other valve assembly having a housing connected to a fluid motor, control orifice means in said housing interposed between said source of pressure fluid and said fluid motor, fluid flow control means in said housing, first control means operable through said fluid flow control means to maintain a pressure differential across said control orifice means at a controlled constant level, and second control means having first means responsive to maximum fluid flow from said source of pressure fluid and second means operable through said fluid flow control means and said first control means to vary the level of said constant pressure differential whereby the level of said constant pressure differential can be progressively lowered by said second means once fluid flow from said source of pressure fluid will approach its maximum flow output and flow demand of said priority flow control system will exceed said maximum flow output.

2. A priority flow control system as set forth in claim 1 wherein said source of pressure fluid includes a pump provided with a load sensing flow control.

3. A priority flow control system as set forth in claim 2 wherein said first means responsive to maximum fluid flow has means responsive to pressure differential developed across said load sensing flow control of said pump.

4. A priority flow control system as set forth in claim 1 wherein said first means responsive to maximum fluid flow has means responsive to pressure differential developed across said priority valve assembly.

5. A priority flow control system as set forth in claim 1 wherein said first means responsive to maximum fluid flow has means responsive to pressure differential across orifice means interposed between said source of pressure fluid and said priority control system.

6. A priority flow control system as set forth in claim 1 wherein said fluid flow control means includes fluid throttling means having actuating means.

7. A priority flow control system as set forth in claim 6 wherein said first means responsive to maximum fluid flow has means responsive to pressure in said actuating means.

8. A priority flow control system as set forth in claim 1 wherein said first control means includes amplifying pilot valve means.

9. A priority flow control system as set forth in claim 1 wherein said second means includes load pressure signal throttling means.

10. A priority flow control system as set forth in claim 1 wherein said priority valve assembly includes control orifice means and fluid flow control means operable to maintain a constant pressure differential across said control orifice means.

11. A priority flow control system supplied from a pump provided with load responsive flow control said priority flow control system including a priority valve assembly operable to control a load and at least one other valve assembly operable to control fluid flow to and from a fluid motor subjected to a load, said other valve assembly having first valve means operable to meter fluid flow of said motor, throttling fluid flow control means operable to throttle fluid flow of said motor, pilot valve means having means responsive to a load pressure related control signal and operable through said throttling fluid flow control means to maintain a constant pressure differential at a preselected constant level across said pilot valve means and to maintain a constant pressure differential across said first valve means during control of said load, and controller means having means responsive to the maximum flow out of said pump and means operable to modify said load pressure related control signal, whereby the level of said constant pressure differential acting across said first valve means can be progressively lowered once said pump reaches its maximum flow output level.

12. A flow control system supplied from a source of pressure fluid and connected to exhaust means said flow control system including at least one valve assembly operable to control a load said valve assembly having a housing connected to a fluid motor, control orifice means in said housing interposed between said source of pressure fluid and said fluid motor, fluid flow control means in said housing, first control means operable through said fluid flow control means to maintain a pressure differential across said control orifice means at a controlled constant level, and second control means having first means responsive to maximum fluid flow from said source of pressure fluid and second means operable through said fluid flow control means and said first control means to vary the level of said constant pressure differential whereby the level of said constant pressure differential can be progressively lowered by said second means once fluid flow from said source of pressure fluid will approach its maximum flow output and flow demand of said flow control system will exceed said maximum flow output.

13. A flow control system as set forth in claim 12 wherein said source of pressure fluid includes a pump provided with a load sensing flow control.

14. A flow control system as set forth in claim 13 wherein said first means responsive to maximum fluid flow has means responsive to pressure differential developed across said load sensing flow control of said pump.

15. A flow control system as set forth in claim 12 wherein said first means responsive to maximum fluid flow has means responsive to pressure differential across orifice means interposed between said source of pressure fluid and said flow control system.

16. A flow control system as set forth in claim 12 wherein said fluid flow control means includes fluid throttling means having actuating means.

17. A flow control system as set forth in claim 12 wherein said first control means includes amplifying pilot valve means.

18. A flow control system as set forth in claim 12 wherein said second means includes load pressure signal throttling means.

* * * * *